United States Patent [19]

Bristol et al.

[11] 4,195,220

[45] Mar. 25, 1980

[54] PORTABLE ELAPSED TIME RECORDER

[76] Inventors: Stanley M. Bristol, 1470 Stonebridge Trail, Wheaton, Ill. 60178; Norman E. Bullock, 7733 Belmont Ave., Elmwood Park, Ill. 60635

[21] Appl. No.: 853,098

[22] Filed: Nov. 21, 1977

[51] Int. Cl.[2] ..... G07C 1/10

[52] U.S. Cl. ..... 235/92 T; 235/92 AC; 235/92 PD; 368/96; 368/46

[58] Field of Search ..... 235/92 AC, 92 T, 92 PD, 235/92 DP; 346/20, 33 R; 58/24 A, 23 R; 364/569

[56] References Cited

U.S. PATENT DOCUMENTS

| | | | |
|---|---|---|---|
| 3,448,459 | 6/1969 | Margolis | 235/92 T |
| 3,781,529 | 12/1973 | Abramson et al. | 235/92 GA |
| 3,889,103 | 6/1975 | Russell et al. | 235/92 T |
| 3,943,526 | 3/1976 | Albertini et al. | 346/33 R |
| 4,065,663 | 12/1977 | Edwards | 235/92 T |

FOREIGN PATENT DOCUMENTS 1476953 6/1977 United Kingdom .

*Primary Examiner*—Joseph M Thesz
*Attorney, Agent, or Firm*—Thomas W. Speckman

[57] ABSTRACT

A portable, self-contained, cummulative elapsed time recorder unit for personal use which records and stores data representing time spent by an individual working on each of a number of different work assignments, to provide a time record for billing purposes. The recorder unit includes a counter which is incremented when the unit operates in a timing mode to record a time element representing time spent working on an assignment, and a memory having a plurality of data storage locations, each assigned to a different work assignment for storing the time elements, the data storage locations being individually addressable by manually operable select switches. The recorder unit includes a display unit which provides a numerical display of the data stored at a selected memory location while the unit is operating in the display mode.

22 Claims, 9 Drawing Figures

DISPLAY 20
DISPLAY DECODER 40
DIGIT DECODER 39
MULTIPLEXER 38
COUNTER 35
Vdd

DISPLAY TIME SLOTS
1 — Q1
2 — Q2
3 — Q6
4 —(202)
5 —(203)
6 (204)Q1'
7 (205)Q6'
PARALLEL SERIAL CONV. 37
TO Q6 (FIG.3)
CLK
S
L
Vdd
80
80a
122
121
125
55
59
57'
30
112
108
107
111
221b
221a
222a
223a
223b
179
180
181
172'
173'
174'
184

PORTABLE ELAPSED TIME RECORDER

BACKGROUND OF THE INVENTION

1. Field of the Invention

This invention relates to elasped time recording apparatus, and more particularly, to a portable, self-contained, cummulative elapsed time recorder unit for providing records of total time spent by an individual working on each of a number of different job assignments during a given period.

2. Description of the Prior Art

The concept of time recording in occupational fields dates back for over a century, and present time recording methods are relatively unchanged. Most time oriented professionals, such as lawyers, accountants, and the like who bill their work on an hourly basis, rely on the wristwatch, memory, or hastily written logs for time control. Accuracy is suspect, and time is misallocated so that billings are lost. While various automatic timekeeping and accounting systems have been proposed for obtaining accurate records of time useful for billing purposes, most of the systems have not gained wide acceptance for various reasons, including complexity, high cost, difficulty of operation, and lack of flexibility.

One known job-accounting recording system disclosed in the U.S. Pat. No. 3,648,243 issued to W. J. Wiggens on Mar. 7, 1972, includes a central unit and a number of remote units, one for each individual for which job-accounting information is desired. Each remote unit comprises a key-set which enables the user to access the central unit and supply coded information, including job and employee identification codes, to the central unit. The central unit responds to the coded information to record start and stop times in association with the job identification number, for future processing by a computer.

Although the patented system allows central recording of job-accounting information from a plurality of remote terminals, it would appear that installation of such system would be costly in view of the need to provide wiring between the central station and each remote terminal unit. Also, the remote unit is useable only at its point of installation, typically an office, and thus, an individual using the system must provide separate accounting for time worked outside of his office.

Moreover, the terminal unit is not provided with a display, and thus, an individual using the unit has no idea of whether or not he has entered the right job identification code at the time he starts work on a given job assignment. Further, although the central unit may include apparatus which provides a printout of start and stop time, such printout is not readily accessible to the user. Also, the printout does not directly indicate the cummulative elapsed time for each work assignment at any time during a billing period, so that it is difficult to determine the total time spent to date on any project until such time as the recorded data is processed by a computer.

In the U.S. Pat. No. 3,911,446, issued to E. J. Albertini on Oct. 7, 1975, there is disclosed a self-contained, timekeeping and accounting unit for use by professional persons. The unit functions automatically to record client identification numbers, work activity codes, and the time spent at the particular work. The unit provides a record of such information on paper tape, or on magnetic tape, which is used in preparing statements. Although the unit provides a numerical display of the client identification number and work code, the unit does not provide a readout of elapsed time, other than that printed on the paper tape when a timing cycle is terminated.

Also, the unit records only individual time elements, and does not provide cummulative elapsed time for each work assignment. Such information can be obtained only by adding up individual time elements recorded for the work assignment for a given billing period. Other similar automatic time-keeping and accounting units are shown in the U.S. Pat. No. 3,808,372 to L. A. Sielsch, and the U.S. Pat. Nos. 3,725,947 and 3,943,526 to E. J. Albertini et al.

In the U.S. Pat. No. 3,922,531, issued to E. Willman et al, on Nov. 25, 1975, there is disclosed a flexitime recorder unit which is used to record "at work" time for a group of employees. The unit has a timing pulse generator, and a number of mechanical roller counters, with switches for connecting the counters to the timing pulse generator, permitting personnel to switch on and off their respective counters when starting and finishing work. While such recorder unit provides a separate time record of "on the job" time for a number of workers, a separate counter is required for each worker.

SUMMARY OF THE INVENTION

The present invention has provided a portable, cummulative elapsed time recorder unit for personal use which records and stores data representing time spent by an individual on diferent work assignments, to provide a time record to billing purposes. The recorder unit includes data processing means operable when enabled to record time elements representing time spent working on work assignments, data storage means for storing data representing the time elements, and display means operable when enabled to provide a numerical display of elapsed time information recorded by the data processing means. The recorder unit further includes control means including timer switch means manually operable to enable the recorder unit to operate in a timing mode in which the data processing means is enabled to record time elements, and display switch means manually operable to enable the recorder unit to operate in a display mode in which the display means is enabled to display elapsed time information.

In accordance with a disclosed embodiment, the data storage means includes a memory having a plurality of data storage locations, each individually assigned to a different work assignment for storing elapsed time data recorded for such work assignment. The data storage locations are individually addressable by way of select means, such as manually operable switches. In an exemplary embodiment, the elapsed time data stored for each work assignment comprises four data words representing tens, units, tenths and hundredths of hours.

The data processing means includes digital pulse containing means, and timing pulse generating means enabled in response to operating of the timer switch means at the start of a timing operation to cause the digital pulse counting means to record a time element which represents the time interval from the start to the end of the timing operation, and thus, the amount of time presently spent working on the work assignment. The timing pulse generating means is operable when enabled to effect the transfer of the data words stored at a memory location selected by the select means to the pulse counting means. The data words preset the counting means an initial count representing the amount of time previously spent working on the work assignment. The counting means is then incremented from its initial count by timing pulses which are provided by the timing pulse generating means until the timing operation is terminated. Thus, the timing element recorded is effectively added to time elements previously recorded for the project, and the data provided by the counting means represents the total time spent to date on that assignment. Such data is written back into the memory at the selected location for use in future timing operations.

When the display switch means is operated, the data words stored at the selected memory location are transferred to the pulse counting means which provides data outputs to the display means representing tens, units and tenths digits of hours, enabling the display means to provide a display of such information.

The elapsed time recorder unit provided by the present invention, which includes a memory for storing data representing time spent on each work assignment, enables recording of elapsed time data for a large number of different job functions. By way of example, the memory may provide as many as 256 separate storage locations. Also, the provision of a memory for storing the data, enables a common counting means to be used for the recording of time elements, and enables a single display unit to be used for displaying the elapsed time data recorded for all of the work assignments. Further, the recorder unit records and stores cummulative elapsed time for each work assignment, and such information can be displayed upon demand, permitting the user to know at any time how much time has been spent working on any assignment.

The recorder unit is easy to use, employing two memory location select switches to provide memory access, and three function select switches to provide timing, display or clear operations. Also, the memory select switches, which indicate the memory location selected, enable the user to know at a glance that he has selected the memory location assigned to the work assignment for which time information is to be recorded or displayed.

In accordance with a further feature of the invention, the pulse counting means may employ presettable up/-down counters which control a suitable indicating means to provide an indication at the end of a preselected time.

The recorder unit may also record the total time spent working on all work assignments, as well as the total time spent working on each individual assignment. Also, the recorder unit may be adapted for use with an external readout/printer apparatus which provides "hard-copy" readout of the information stored in the memory.

The recorder unit is a portable self-contained unit of small size, enabling the unit to be stored in a desk drawer when not in use, or carried in a briefcase or coatpocket. Also, the electronic circuits of the recorder unit employ CMOS type devices, which are characterized by low power consumption, enabling the unit to be battery operated, while providing maximum lifetime for the battery.

DESCRIPTION OF THE DRAWINGS

FIGS. 3-6 are to be arranged.

DESCRIPTION OF A PREFERRED EMBODIMENT

General Description

Figures 1, 2:
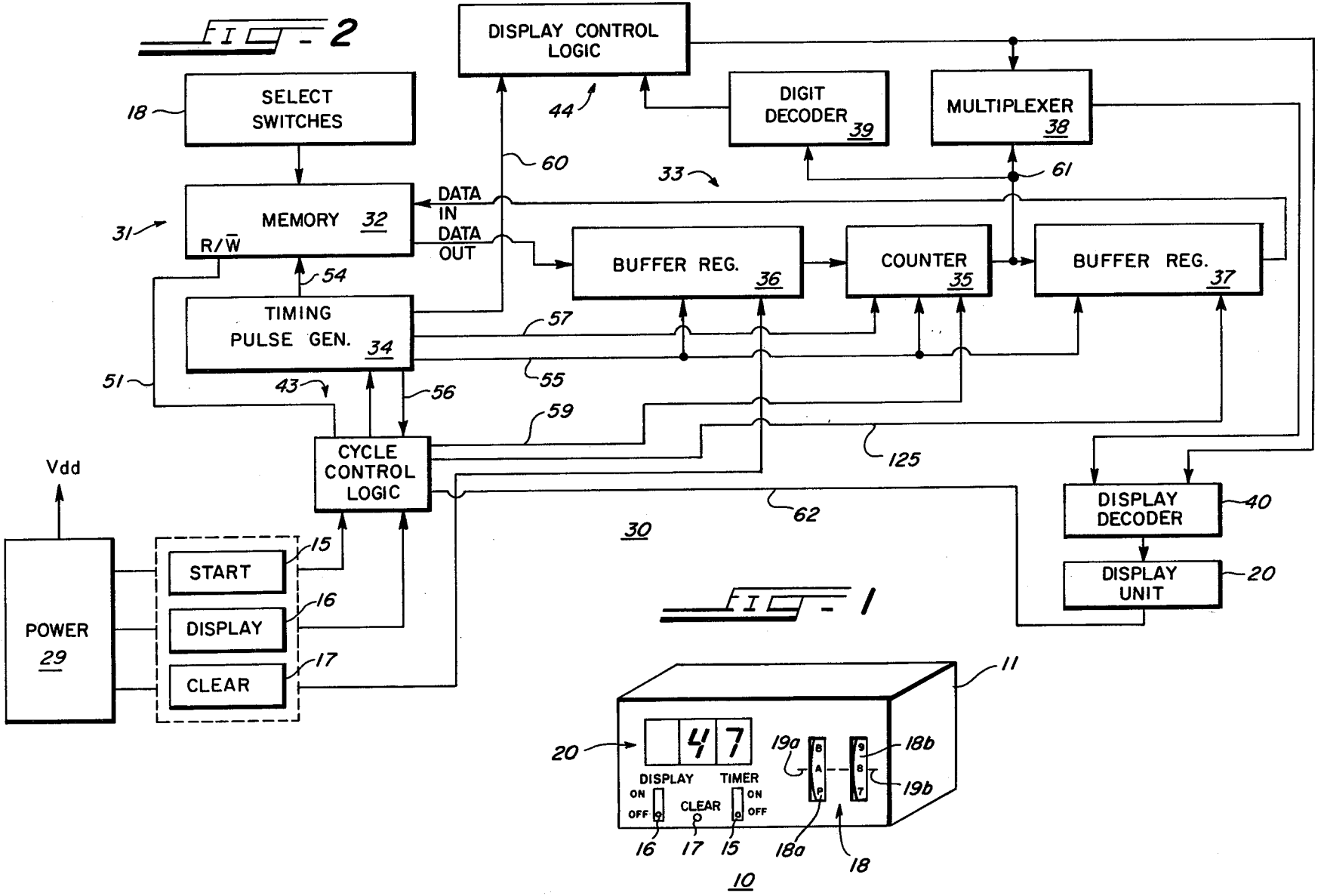
FIG. 1 is a perspective view of an elapsed time recorder unit provided by the present invention.
FIG. 2 is a block diagram of recorder circuits for the recorder unit shown in FIG. 1.

Referring to FIG. 1, the time recorder unit 10 provided by the present invention is basically an elapsed time recorder which may be used, for example, to provide work associated time records for billing purposes. The recorder unit 10, which is a portable self-contained unit, is particularly suitable for personal use by individuals, such as lawyers, accountants, or the like, who bill their work on an hourly basis, and who may do work for several different clients or customers in a given day. The time recorder unit 10 allows the user to keep track of the actual time spent working on one or more jobs or assignments for one or more clients during a given billing period, thereby providing an accurate itemized record of time which is billable to each client.

The recorder unit 10 has a timer switch 15 which the user operates to the "on" position when he begins work on an assignment for which a time record is to be maintained. When the timer switch 15 is in the "on" position, the recorder unit operates in a timing mode to record elapsed time until the timer switch 15 is subsequently operated to the "off" position when work on such assignment is completed or temporarily interrupted. The elapsed time, or time element, recorded during such interval corresponds to the amount of time spent working on the assignment. The recorder unit 10 accumulates the time elements during a given billing period providing a record of cummulative elapsed time for each assignment. Thus, the time element last recorded added to time elements previously recorded for the same project represent the total time spent to data on that assignment.

As indicated above, the recorder unit 10 allows the user to record elapsed time for a number of different clients or job functions. To this end, select switches 18 are provided which enable the user to designate a given job function for which a time element is to be recorded. In the illustrative embodiment, the select switches 18 comprise thumbwheel switches **18*a* and 18*b*, one of the switches, 18*a*, having alphabetical characters such as the letter "A" shown aligned with an index mark 19*a*. The other switch 18*b* has numerical designations, such as the number 8 shown aligned with index mark 19*b*. Each job function for each client is assigned a different alphanumeric code which is entered into the recorder unit by way of the select switches 18** whenever working time is to be recorded for such job function. A code sheet may be utilized, if desired, for listing the codes assigned to each job function.

The recorder unit 10 also includes a numerical display unit 20 which permits the display of the cummulative elapsed time recorded by the recorder unit 10 for any one of the job functions. The display of time information is effected by operating a display switch 16 which, when operated to the "on" position, renders the recorder unit 10 operable in a display mode which causes display of the cumulative elapsed time recorded for the job function or client designated by the setting of the select switches 18. In the illustrative embodiment, the display unit 20 provides a three digit, numerical display of time representing tens, units and tenths of hours. In the exemplary embodiment, wherein an LED type display is used, time is displayed only when the display switch 16 is operated, and is not automatically displayed while the recorder unit 10 is operating in the timing mode. This minimizes power requirements for the unit 10, enabling it to be battery operated thereby enhancing portability of the unit. However, is apparant that other types of display units, such as a liquid crystal display could be used, allowing continuous display in either operating mode.

The recorder unit 10 includes electronic circuits 30 shown in block diagram form in FIG. 2, which are controlled by the timer switch 15, the display switch 16, and the select switches 18 to provide the elapsed time recording and display functions. Briefly, the recorder circuits 30 include data storage circuits 31, which store the elapsed time data, data processing circuits 33, which provide the elapsed time data, cycle control circuits 43, which control the operation of the data storage and data processing circuits, display control logic 44, and display decoder circuits 40, which control display unit 20. The recorder circuits are powered by a DC source 29, which may be a battery.

The data storage circuits 31 include a memory 32 which stores the time elements recorded for the various work assignments. The memory 32 provides a separate block of data storage locations for each job function for which elapsed time is to be recorded, each block of data storage locations being individually addressable by way of the select switches 18.

The data processing circuits 31 include digital pulse counting circuits 35 and timing pulse generating circuits 34 which respond to enabling signals provided by the control logic circuits 43 to time the duration of elapsed time intervals as represented by the times for which the timer switch 15 is in the "on" position. The data processing circuits 33 also provide control signals and data signals to the display logic and decoder circuits to effect display of elapsed time data.

The control logic circuits 43 are controlled by the function select switches, including the timer switch 15 and display switch 16, to enable the recorder unit to operate in the timing mode and/or the display mode. When the recorder unit 10 is operating in the timing mode, the data processing circuits record elapsed time intervals to provide digital data representing the duration of such intervals. The elapsed time interval data thus provided is stored in the memory 12. Also, for the case where elapsed time was previously recorded for a given job function, the elapsed time data stored is transferred to the digital counter circuits and modified to reflect additional time spent on the project.

When the recorder unit is operating in display mode, the data processing circuits provide inputs, representing the data to be displayed to the display decoder circuits 40, which drive the display unit 20. Also, the timing pulse generating circuits 34 provide timing signals to the display control logic 44.

The manner in which the electronic circuits 30 are operable to provide elapsed time recording and display functions are described in detail hereinafter.

The recorder unit 10 is simple to use. For example, to record time spent working on a given assignment, the user first sets the select switches **18*a* and 18*b* to the code assigned to such assignment. For example, if the assigned code is A8, the thumbwheel switch 18*a* is set to align the letter "A" with index mark 19*a*, and the thumbwheel switch 18*b* is set to align the number "8" with index mark 19*b*. Then, when the individual is ready to start work on the assignment, he operates the timer switch 15 to the "on" position, and the recorder unit 10** begins the timing function.

If work on this project is temporarily interrupted, such as by a telephone call, the recorder unit 10 can be placed in the standby mode by operating the timer switch 15 to the "off" position, temporarily inhibiting the timing operation of the recorder unit 10. When work is resumed, following the interruption, the user operates the timer switch 15 back to the "on" position allowing the recorder unit 10 to continue its timing operation.

When work on this assignment is completed, the recorder unit 10 is placed in the standby mode by operating timer switch 15 to the "off" position. If then the individual desires to record time spend working on a different project, he then sets the select switches to the code assigned to the further project, and operates the timer switch 15 to the "on" position when he is ready to begin work on the new project.

If at any time the individual desires to see how much time has been spent working on any one of the projects, such as the project having the assigned code A8, he sets the select switches **18*a* and 18*b* to such code, and then operates the display switch 16 to the "on" position. This causes the elapsed time to date for the designated project to be displayed on the display unit 20**.

At the end of each billing period, the recorder unit 10 stores a record of the cummulative elapsed time for each project on which work was done during the billing period. Such time information can be "read out" by displaying the cummulative elapsed time for each of the projects, while writing down the displayed time information for use in the preparation of bills for the clients or customers. Alternatively, the time information can be read out automatically through the use of accessory apparatus as described in more detail hereinafter.

After the elapsed time data for a designated project has been "read out", obtaining the necessary information for billing purposes, the elapsed time data as stored by the recorder unit, for such project can be cleared or reset to zero in preparation for the start of the next billing period. A clear operation is effected by operating a clear switch 17 of the recorder unit and the display switch 16.

The recorder unit 10 is of relatively small size, enabling the unit to be stored in a desk drawer when the unit is not in use, or carried in a coat pocket. By way of example, on one model the housing 11 was 6 inches long, 4 inches wide and 1 $\frac{1}{4}$ inches deep. Also, as indicated above, the recorder unit is battery operated, thus enhancing the portability of the unit.

Recorder Circuits

Referring to the block diagram of the recorder circuits 30 shown in FIG. 2, the memory 32 provides a separate block of data storage locations corresponding to each work assignment, for storing the elapsed time recorded for such work assignment during a given billing period. In the exemplary embodiment, the elapsed time data for each work assignment comprises four four-bit words representing tens, units, tenths and hundredths of hours, respectively.

Each block of data storage locations is individually addressable by way of the select switches 18 which enable the data words stored in a given block of memory locations to be read out for use by the data processing circuits 33, and which enable data words provided by the data processing circuits 33 to be written back into the memory at the selected locations.

The elapsed time data is read out of the memory at the start of each timing or display operation and written back into the memory. For each timing operation, the data read out is modified to reflect additional elapsed time, with the modified data being written back into the memory periodically until the end of the timing operation.

The control logic circuits 43 provide an enabling signal which is extended over line 51 to a control input $R/\overline{W}$ of the memory 32 to select read and write operating modes for the memory 32. The cycle control logic circuits 43 respond to the operation of either the timer switch 15 or the display switch 16 to the "on" position to initiate a read cycle. During the read cycle, the data words stored at the locations indicated by the select switches 18 are read out of the memory 32 and transferred to the counter 35 by way of a buffer register 36. At the end of the read cycle, the cycle control logic initiates a write cycle, causing data words stored in the counter to be transferred to the memory 32 by way of buffer register 37.

The synchronization of the data transfer operations and the transfer from read to write cycles is effected by timing pulses provided by the timing pulse generating circuits 34. The timing pulse generating circuits 34 are enabled by the cycle control logic circuits 43 in response to the operation of either the timer switch 15 or the display switch 16 to the "on" position. The timing pulse generating circuits 34 are inhibited when the timer and display switches are in the "off" position.

The timing pulse generating circuits 34 are operable when enabled to supply timing pulses over lead 54 to the memory 32 to effect serial read out of the data words stored in the block of storage locations designated by the settings of the select switches 18. Further timing pulses are provided by the timing pulse generating circuits 34 over lead 55 for synchronizing the transfer of the data words to the buffer register 36 and to the counter 35 during the read cycle, and for synchronizing the transfer of the data words provided by the counter 35 from the buffer register 37 to memory 32 during the write cycle. A control output, provided over line 56 at a predetermined time after the start of the read cycle, enables the cycle control logic circuits 43 to transfer memory operation from the read cycle to a write cycle.

During a timing operation, the data transferred to the counting circuits 35 is incremented by timing pulses provided over lead 57 by the timing pulse generating circuits 43. In the exemplary embodiment, the timing pulse generating circuits 34 provide pulses to counter circuits 35 at a rate of one pulse every thirty-six seconds, incrementing the counting circuits 35 at a rate corresponding to one-hundredth of an hour. The counting circuits 35 are enabled to respond to the incrementing pulses by a control signal provided over line 59 by the cycle control logic circuits 43 whenever the timer switch 15 is operated to the "on" position.

For the condition where elapsed time has not been previously recorded for the selected work assignment during the billing period, the data read out of the memory 32 causes the counting circuits 35 to be initially set to a count of zero and incremented from a count of zero at the thirty-six second rate as long as the timer switch 15 remains in the "on" position. When elapsed time has been previously recorded for such work assignment, the data read out of the memory causes the counting circuits 35 to be set to an initial value corresponding to the elapsed time previously recorded. The counting circuits 35 are then incremented from such initial value until the timer switch 15 is operated to the "off" position at which time, the count represents the cummulative elapsed time for the selected work assignment, and data representing such count is written back into the memory 32.

For a display operation, the data words at the selected memory locations are transferred to the counting circuits 35 as described previously for the timing operation. However, during the display operation, the cycle control logic circuits 43 prevent the counting circuit 35 from receiving incrementing pulses.

As indicated above, in the exemplary embodiment, the display unit 20 provides a three digit display representing tens, units, and tenths of hours. The display unit may, for example, include three seven-segment LED type display devices. The data words representing such time information are extended over line 61 from outputs of the counting circuits 25 to the multiplexing circuits 38. The timing pulse generating circuits 34 provide timing pulses over line 60 to the display control logic 44 which enable the multiplexer circuits 38 to sequentially extend data words, representing tens, units, and tenths of hours, to the display decoder circuits 40. The display control logic circuits 44 also enable the display decoder circuits 40 to respond to each data word to effect energization of the corresponding digit of the display unit 20. The digit decoder circuits 39 respond to outputs of the counting circuits 35, representative of the codings for units and tens digits, to provide control of logic circuits 44, permitting blanking of initial zeros for the tens and units digits. The cycle time of display control logic circuits 44 along with the persistance of the eye allow simultaneous display of the three digit representation of elapsed time information as long as the display switch 16 is operated to the "on" position.

The recorder circuits 30 are continuously energized by DC power from the DC supply 29 which is assumed to be a battery. However, the display unit 20 is energized only when the recorder unit 10 is operating in the display mode.

OPERATION

Briefly, in operation, to record an elapsed time element, for a given work assignment, such as one having the select code A8, the user sets the select switches 18 to correspond to the coding A8 for such work assignment. This selects the memory location from which the elapsed time data is to be read out, and prepares the memory 32 to output the data at such location. By way of example, it is assumed that the data stored at memory locations A8 represents a cummulative elapsed time of 4.2 hours.

Then when the user operates the timer switch 15 to the "on" position, the timing pulse generating circuits 34 are enabled over the cycle control logic circuits 43 to provide timing pulses over line 54 for effecting read out of the data from the memory 32. The timing pulse generating circuits 34 also provide synchronizing pulses over line 55 for controlling the transfer of the data from the memory 32 to the counting circuits 35, and incrementing pulses over line 57 for incrementing the counting circuit 35. The cycle control logic circuits 43 provide a control output over line 51 for enabling the memory to be operable in the read mode, and a further output over line 59 for enabling the counting circuits to receive the incrementing pulses provided by the timing pulse generating circuits 34.

The timing pulses provided over line 54 cause the four data words representing the elapsed time data to be read out serially and loaded into the buffer register 36 under the control of the synchronizing pulses provided over line 55. The four data words are also transferred from the buffer register 36 to the counting circuits 35, under the control of the synchronizing pulses on line 55 so that the counting circuits 35 are set to a count corresponding to the elapsed time indicated by the data words read out of the memory 32.

After the data words have been loaded into the counting circuits 35, the timing pulse generating circuits 34 provide a control output over line 56 for enabling the cycle control logic circuits 43 to transfer memory operation from the read mode to the write mode. The duration of the read cycle is considerably less than thirty-six seconds, so that the elapsed time data read out of the memory 32 in response to operation of the timer switch 15 is loaded into the counting circuits 35 before the first incrementing pulse is supplied to the counting circuits 35.

The counting circuits 35 are then incremented at the thirty-six second rate so that the state of the counting circuits 35 reflects the additional time spent working on the assignment. The cycle control logic circuits 43, under the control of the timing pulse generating circuits 34, periodically cause the data words stored in the counting circuits 35 to be loaded into the buffer register 37 and transferred serially to the memory 32 under the control of the synchronizing pulses provided over line 55. The data is written into the memory 32 at the locations designated by the select switches 18 under the control of timing pulses provided over line 54. Accordingly, when the timer switch 15 is subsequently operated to the "off" position, returning the unit 10 to the standby mode, the data stored at such locations represents the current total of elapsed time spent working on the assignment. Assuming that the duration of the recording operation was a half hour, then the cummulative elapsed time recorded by the counting circuits 35 is 4.7 hours, and the data which is stored at memory location A8 represents such time.

To display the time information now recorded for the job function having the code A8, the display switch 16 is operated causing the cycle control logic circuits 43 to enable the timing pulse generating circuits 34. Since the cycle control logic circuits 43 enable the memory 32 to be initially operable in the read mode, the timing pulses provided by the timing pulse generating circuits 34 effect read out of the data words stored at the location A8 as designated by the select switches 18*a* and 18*b*. Accordingly, the selected data words now representing an elapsed time of 4.7 hours, are transferred to the counting circuits 35 as described above. During a display only operation, the cycle control logic circuits 43 provide an inhibit signal over line 59 which prevents the counting circuits 35 from responding to the incrementing pulses provided by the timing pulse generating circuits 34. Also, the control logic 43 provides an output over line 62 for energizing the display unit 20. It is pointed out that the elapsed time data can be displayed during a timing operation by operating both the display switch 16 and the timer switch 15 to the "on" position. In this mode, the counting circuits 35 are incremented as in a timing operation and the information displayed represents the the current state of the counting circuits.

The timing signals provided by the timing pulse generating circuits over lines 60 control the display control logic circuits 44 to enable the multiplexer circuits 38 to selectively extend the data words representing the tens digit which is zero, the units digit which is four, and the tenths digit which is 7, to the display decoder circuits 40. The digit decoder circuits 39 respond to the tens digit to cause the display logic circuits 44 to inhibit the display of the initial zero for the tens digit so that the display unit 20 provides a numerical display of 4.7 as shown in FIG. 1.

It is pointed out that the timing pulse generating circuits 34 provide timing pulses which enable the cycle control logic circuits 43 to transfer the memory 32 from the read cycle to the write cycle, and to periodically effect the writing of the data words stored in the counting circuits back into the memory 32 as described above for the timing operation. When the display switch 16 is operated to the "off" position, the display unit 20 is deenergized and the recorder unit 10 is returned to the standby mode.

To clear, or reset to zero, the data in a given block of memory storage locations, such as the memory storage locations designated by the code A8, the clear switch 17 (FIG. 1) is operated, causing the buffer 36 to be reset to zero. Then the display switch 16 is operated, effecting readout of the memory 32 as in the display operation as described above. However, since the clear switch 17 is operated, the data words loaded into the counting circuits 35 cause the counting circuits 35 to be set to a count of zero so that all zeros are read into memory locations A8 during the write portion of the clear/display operation. Also, the display unit 20 displays a zero for the tenths digit, the initial tens and units digits being suppressed. Release of the clear switch 17 and operation of the display switch 16 returns the recorder unit 10 to the standby mode with the memory locations A8 cleared or reset to zero.

DETAILED DESCRIPTION

Figures 3, 4, 5, 6, 9:
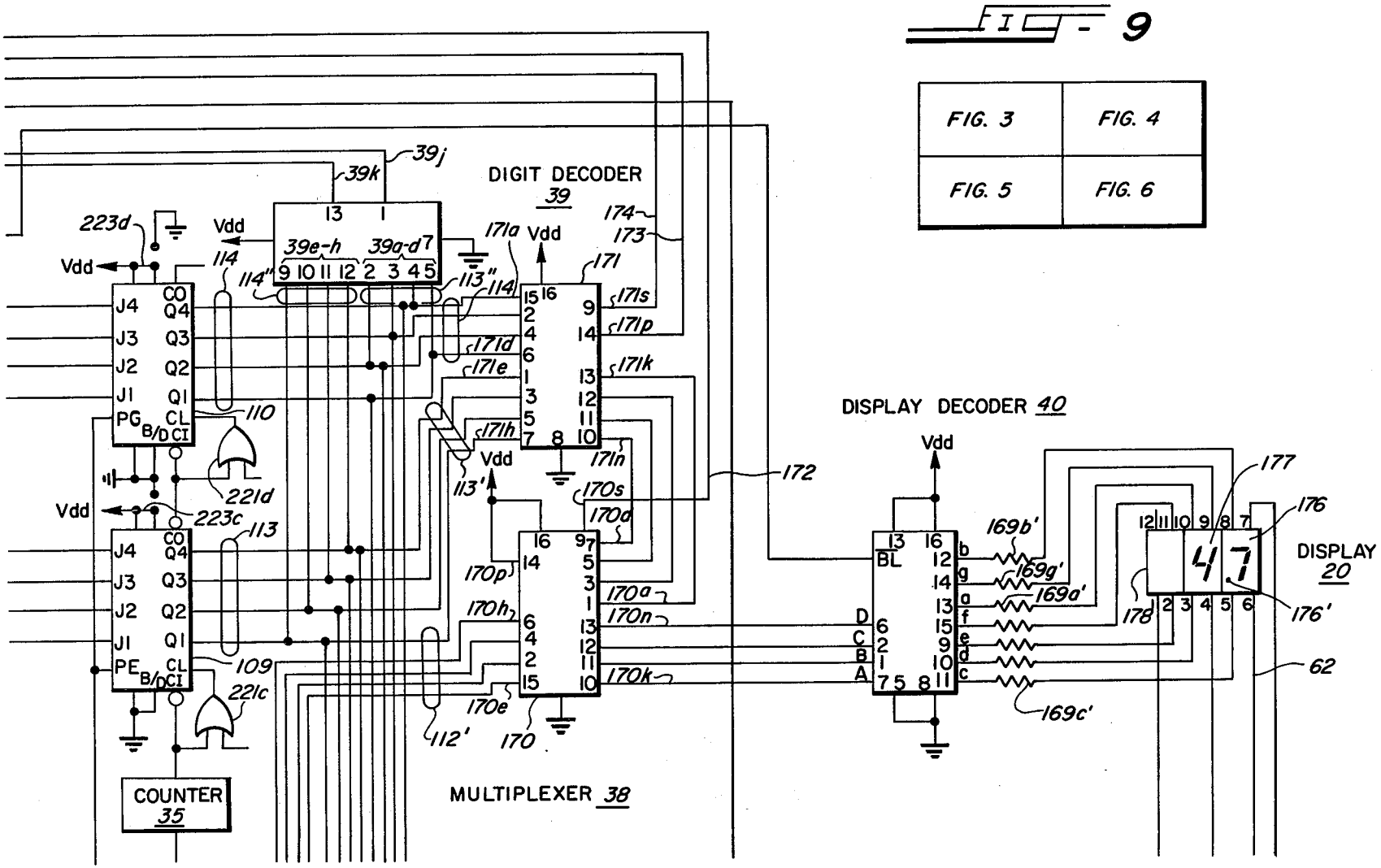
Figure 5:
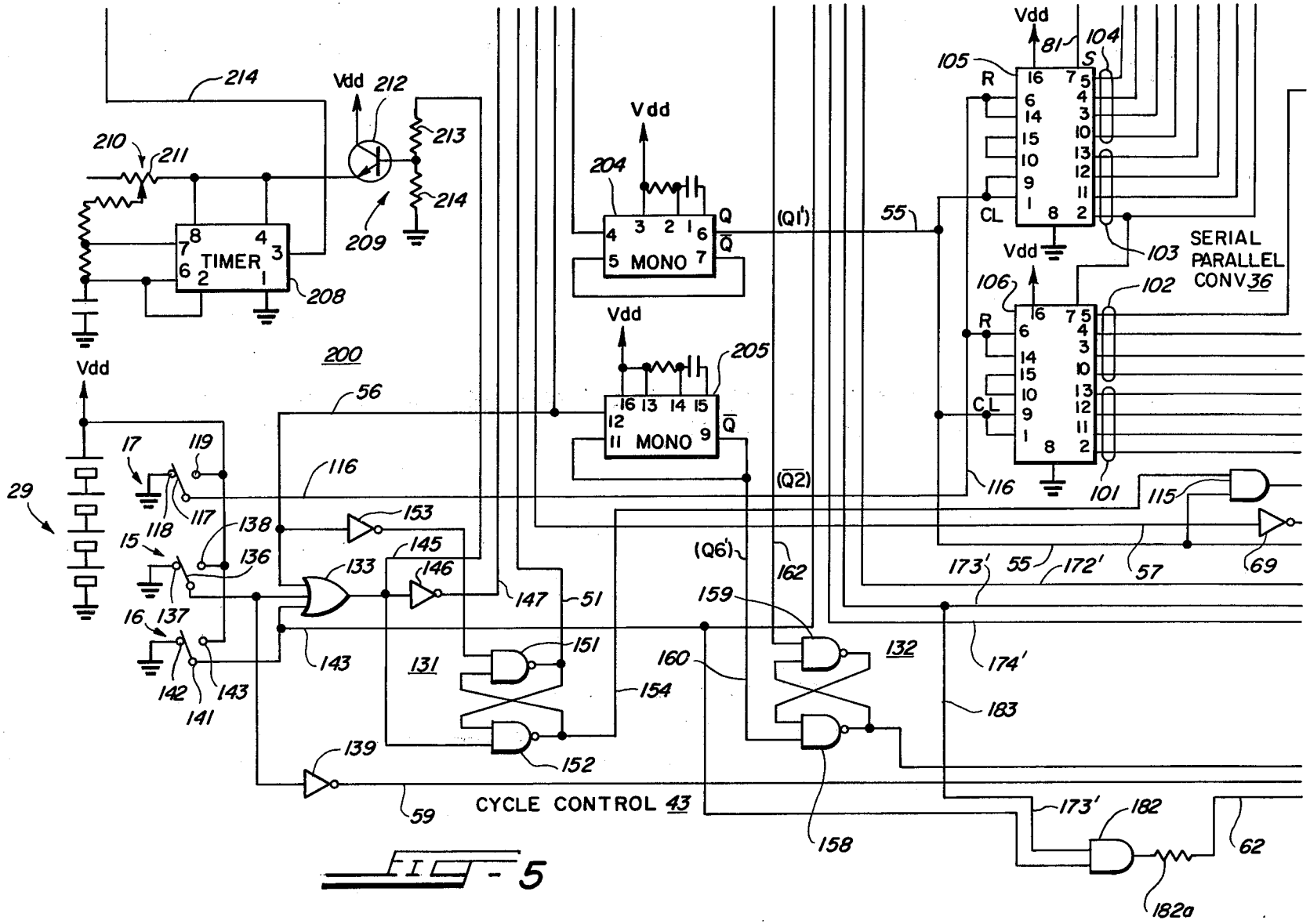

FIGS. 3-6, when arranged as shown in FIG. 9, provide a schematic circuit and partial block diagram of the recorder circuits 30. The recorder circuits 30 are energized from the DC source or battery 29, shown in FIG. 5, which is connected between a power output Vdd and ground for the circuits 30. The battery may, for example, comprise four penlite cells providing +6 VDC at output Vdd. It is apparant that the recorder unit 10 may be provided with an AC adapter (not shown) to derive 6 VDC for the recorder circuits 30 from an AC power source.

The recorder circuits 30, other than the display unit 20, are continuously energized. However, the recorder circuits 30, including the memory circuits 32, employ CMOS type devices thereby minimizing power consumption. For example, in one unit, power consumption for the recorder circuits 30 was less than sixty microwatts for the standby mode, six to twelve milliwatts for the timing mode, and forty-eight milliwatts for the display mode for a minimum display and 480 milliwatts when all segments of the LED display devices are energized.

Memory and Select Switches

Figure 3:
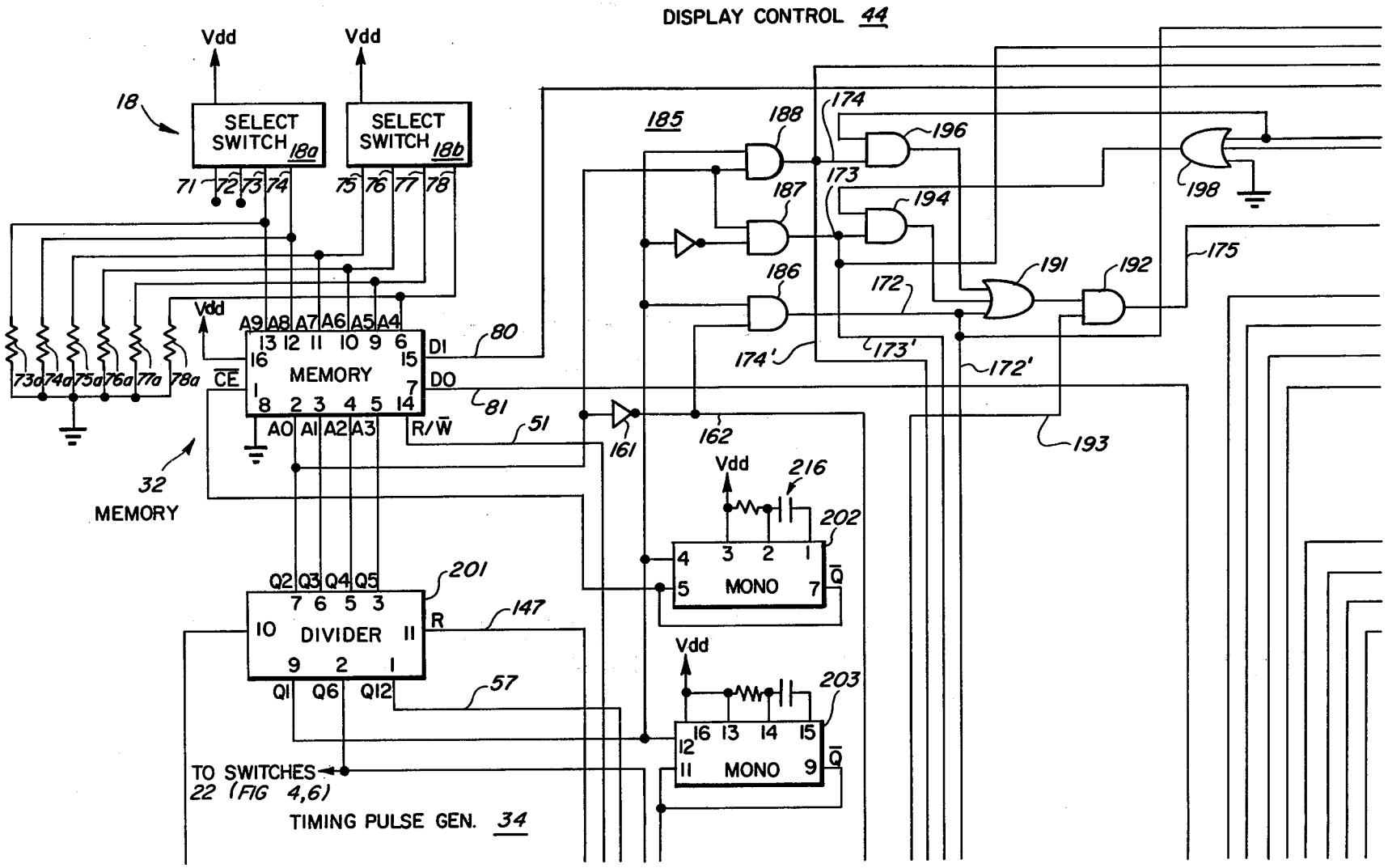
FIGS. 3-6, when arranged as shown in FIG. 9, provide a schematic circuit and partial block diagram of the recorder circuits shown in FIG. 2.

Referring to FIG. 3, the memory circuits 32 comprise an integrated circuit CMOS RAM memory chip, such as the Harris Semiconductor Type HM6508/1024 bit memory. In the exemplary embodiment, the elapsed time data for each project is represented by four, four-bit words representing tens, units, tenths and hundredths of hours, respectively. In such application, the memory circuits 32 provide sixty-four separate 16-bit blocks of data storage location, permitting storage of elapsed time data for sixty-four different job functions.

Selection of a given block of data storage locations is effected by the select switches 18. The data words are written into (or read out of) the selected memory locations under the control of timing pulses provided by the timing pulse generating circuits 34. The data words are read (or written) serially with the least significant digit, representing hundredths of hours, being read out first and the most significant digit, representing tens of hours being read out last.

Considering the memory circuits 32 in more detail, power is supplied to the memory chip over power inputs at pins 16 and 8 which are connected to Vdd and ground, respectively. The memory read/write select input $R/\overline{W}$ is controlled by the cycle control logic circuits 43 which select read or write modes for the memory. The memory has row/column select inputs A0–A9 and a chip enable input $\overline{CE}$ for enabling data selection and read/write operations. An input DI of the memory receives serial data to be written into a block of storage locations, designated by select switches 18; data being read out of a block of storage locations is provided at an output D0. Input DI is connected over lead 80 to the output of the buffer register 37 to receive data from the counting circuits 35, and output D0 is connected over lead 81 to the input of the buffer register 36 to supply data to the counting circuits 35.

The select switches **18*a* and 18*b* which permit selection of a sixteen bit block of memory storage locations have power inputs connected to Vdd, and respective outputs 73–74 and 75–78 connected to row/column select inputs A9–A4 of the memory, and over resistors 73*a*–78*a*** to ground.

In the exemplary embodiment, switches **18*a* and 18*b* are each sixteen position thumbwheel switches which provide binary coded decimal outputs over outputs 71–78 representative of the settings of the two switches. In the exemplary embodiment, only sixty-four discrete codings are needed to address the 1024 bit memory, and accordingly, only four positions of switch 18*a* are used, and outputs 71 and 72 of switch 18*a*** are not connected.

It is pointed out that the memory may be expanded by using a memory chip having 4096 bit locations. This would increase the number of blocks of addressable data storage locations to 256 each individually addressable using the existing select switches **18*a* and 18*b***.

Data Transfer and Counting Circuits

Buffer register 36, shown in FIG. 5, operates as a serial-to-parallel converter, receiving the four, four-bit words from the memory serially over lead 81, and providing the four, four-bit in parallel over four sets of output leads 101–104 which are connected to inputs of the counting circuits 35. The counting circuits 35, shown in FIGS. 4 and 6, comprise four decade counter 107–110 which receive the four bit data words representing hundredths, tenths, units and tens of hours, respectively. The outputs of the counter 107–110 are extended in parallel over respective sets of output leads 111–114 to inputs of buffer register 37 which operates as a parallel-to-serial converter, receiving parallel data from the counter 107–110 and providing serial data to the memory over lead 80.

Referring to FIG. 5, the serial-to-parallel converter 36 comprises two eight-bit shift registers 105 and 106, such as the Motorola Type 4015, CMOS shift register. Shift register 105 has its serial input at pin 7 connected to lead 81 and thus to memory output D0 and shift register 106 has its serial input at pin 7 connected to the output at pin 2 of the last stage of shift register 105 so that the shift register 105 and 106 are connected in tandem. The serial data is loaded into the shift registers 105 and 106 during read cycles under the control of the timing pulses Q1′ supplied over line 55 to clock inputs at pins 9 of the shift registers 105 and 106. The shift registers 105 and 106 have reset inputs at pins 6 connected over lead 116 to the switch arm 117 of the clear switch 17. Switch 17 has contacts 118 and 119 connected to ground and Vdd, respectively. Switch arm 117 normally engages contact 118 providing ground to the reset inputs of the shift registers 105 and 106. When the clear switch 17 is operated, switch arm 117 engages contact 119 extending +Vdd to the reset inputs, to clear the shift registers 105 and 106.

Referring to FIGS. 4 and 6, the decade counters 107–110 may each comprise the RCA Type 4029 CMOS decade counter. Each decade counter has data inputs, such as inputs 107J1–107J4 for counter 107, for receiving the data words provided over lead sets 101–104 by the serial-to-parallel converter 36. The four data words cause the four counters 107–110 to be preset to the counts indicated by the data words loaded into the counters. The data words provided over lead sets 101–104 are loaded into the four counters 107–110 in response to clock pulses Q1′ gated to parallel enable inputs PE of the counters 107–110 over an AND gate 115, which is enabled by the cycle control logic circuits 43 during read cycles.

Each counter has data outputs, such as outputs 107Q1–107Q4 for counter 107, for providing data words representing the states of the four counters 107–110 over respective lead sets 111–114 to the parallel-to-serial converter 37. The incrementing pulses at the thirty-six second rate are supplied to a clock input of counter 107 which is connected to lead 57. Counters 107–109 have carry outputs connected to carry inputs of counters 108–110, respectively, enabling counters 107–109 to increment respective counters 108–110 when full counts are reached by one of the counter 107–109.

Referring to FIG. 6, the parallel-to-serial converter 37 comprises two eight-bit shift registers 121 and 122, such as the Motorola Type 4014 CMOS shift register. Shift register 121 has its parallel inputs connected to lead sets 111 and 112 to receive the two four-bit data words representing hundredths and tenths of hours, and shift register 122 has its parallel inputs connected to lead sets 113 and 114 to receive the two four-bit data words representing units and tens of hours. The serial output at pin 3 of shift register 122 is connected to the serial input at pin 11 of shift register 121 which has its serial output at pin 3 connected to lead 80, and over lead 80*a* to the serial input at pin 11 of the shift register 122.

During write cycles, the parallel data provided over lead sets 111–114 is loaded into the shift registers 121 and 122 in response to load enable pulses supplied over lead 125 to load inputs at pin 9 of the shift registers by the cycle control logic circuits 43. Data stored in the shift registers 121 and 122 is read out serially under the control of timing pulses Q1′ provided over lead 55 by the timing pulse generating circuits 34. The data read out of the parallel-to-serial converter 37 is supplied over lead 80 to the input DI of the memory. The data is also provided over lead 80*a* to serial input of shift register 122, enabling the data to be circulated through register stages 121 and 122 during the serial read out operation.

Cycle Control Logic

Referring to FIG. 5, the cycle control logic circuits 43 include a read/write latch 131, an output control latch 132, and a function select gate 133. The function select gate 133 responds to operation of either the timer switch 15 or the display switch 16 to enable the timing pulse generating circuits 34 to initiate a timing or display operation. The read/write latch 131, which controls the memory 32, is normally reset, selecting the read mode for the memory 32. The read/write latch 131 also primes AND gate 115 enabling clock pulses Q1′ to be supplied to the counter circuits 107–110 for loading the parallel data provided by parallel-to-serial converter 36 into the counters. The read/write latch 131 is set by a timing pulse Q6 provided by the timing pulse generating circuits 34 to transfer memory operations from read to write. The output control latch 132 controls the loading of data into the parallel-to-serial converter 37.

More specifically, the function select gate 133 is embodied as a three input OR gate, have first and second inputs connected to the timer switch 15 and the display switch 16, respectively, and a third input connected over lead 56 to an output of the timing pulse generating circuits 34 to receive a timing pulse Q6. Timer switch 15 is a two position switch having a switch arm 136 engaging a grounded contact 137 when the switch is in the "off" position, and engaging a contact 138, which is connected to Vdd, when the switch 15 is operated to the "on" position. Switch arm 136 is also connected over an inverter 139 and lead 59 to the carry input of counter 107, enabling the counter 107 to respond to incrementing pulses. Display switch 16 is also a two position switch having a switch arm 141 engaging a grounded contact 142 when the switch is in the "off" position and which engages a contact 143, connected to Vdd, when the switch 16 is operated to the "on" position. Thus, when switches 15 and 16 are in "off" positions, and in the absence of timing pulse Q6, ground, or logic 0, is provided at all the inputs of the OR gate 133 and the gate is disabled. When either switch is operated to the "on" position, a voltage at level Vdd, or logic 1, is extended to an input of the gate 133, enabling the gate 133. The output of gate 133 is connected over lead 145 to an oscillator 200 of the timing pulse generating circuits 34, and over an inverter 146 and lead 147 to a pulse divider circuit 201 (FIG. 3) of the timing pulse generating circuits to initiate the generation of timing pulses. The output of gate 133 is also connected to the reset input of read/write latch 131 to effect reset of the latch 131 at the end of a timing or display operation.

The read/write latch 131 is comprised of two cross-coupled NAND gates 151 and 152. The latch 131 is set at the time a pulse Q6 is provided by the timing pulse generating circuits 34, the pulse Q6 being inverted by an inverter 153 which is connected between lead 56 and an input of gate 151. The latch 131 is reset whenever OR gate 133 is disabled such as when, in the absence of pulse Q6, either switch 15 or 16 is operated from the "on" position to the "off" position, or when timing signal Q6 goes low and both switches 15 and 16 are at "off" positions.

The true output of latch 131, at the output of gate 151, is connected over lead 51 to the mode select input $R/\overline{W}$ of the memory 32, selecting the read mode when the latch 131 is reset and the write mode when the latch is set. The false output of the latch 131, at the output of gate 152, is connected over lead 154 to an input of gate 115 to prime gate 115 when latch 131 is reset, and to inhibit gate 115 when latch 131 is set.

The output control latch 132 is also comprised of two cross-coupled NAND gates 158 and 159. The latch 132 is set in response to a pulse supplied to an input of gate 158 over lead 160 from a monopulser 205 of the timing pulse generating circuits 34. The monopulser 205 is enabled by timing pulse Q6 which initiates the transfer from read to write cycles for the recorder circuits. The latch 132 is reset in response to a timing pulse $\overline{Q2}$ provided by the timing pulse generating circuits 34 and extend by lead 162 to an input of gate 159.

The true output of the latch 132, at the output of gate 158 is connected over lead 125 to the load enable input of shift registers 121 and 122 (FIG. 6). Thus, whenever latch 132 is set, the data provided on lead sets 111–114 is jammed into the shift registers 121 and 122 at the positive transition of the latch output. When the latch 132 is thereafter reset in response to the occurrence of the next timing pulse Q2, the shift registers 121 and 122 are enabled to respond to clock pulses Q1′ which effect serial readout of the shift registers at the positive transition of the clock pulses.

At the start of each timing or display operation, the read/write latch 131 is initially in a reset state, selecting the read mode for the memory 32. When timing pulse Q6 is provided, the latch 131 is set, selecting the write mode for the memory 32. The latch 131 then remains set until the timing or display switch is operated "off". When the read mode is terminated, the output control latch 132 is periodically set and reset by timing signals Q6 and $\overline{Q2}$ for the duration of the timing or display operation, enabling the data words stored in the counters 107–110 to be written into the memory 32. This assures that at the end of each timing cycle, for example, data representing the current state of the counters 107–110 has been stored in the memory 32.

Display Circuits

Referring to FIGS. 4 and 6, in the exemplary embodiment, the display unit 20 comprises a three digit LED display having three seven segment devices 176–178 which enable display of tens, units, and tenths of hours. Segment selection for each digit is provided by the display decoder 40, and digit selection is provided by the multiplexer circuits 38 under the control of the display control logic 44 shown in FIG. 3.

The multiplexer circuits 38 comprise two eight-bit multiplexers, 170 and 171, such as the RCA Type 4019 CMOS multiplexer circuit. Multiplexer 171 has data inputs 171*a*–171*d* and 171*e*–171*h* for receiving the tens and units data words, respectively, provided over respective lead sets 114' and 113' which are multipled with lead sets 114 and 113 at the outputs of the counter circuits 109–110. Data outputs **171*k*–171*n* of the multiplexer 171 are connected to data inputs 170*a*–170*d* of multiplexer 170, which has further data inputs 170*e*–170*h* connected to output leads 112' which are multipled with leads 112 to receive the tenths data words provided at outputs of counter 108. Multiplexer 170 has data outputs 170*k*–170*h* connected to data inputs 169A–169D of the display decoder 40**, which may be the Motorola Type 4511 CMOS seven segment display decoder.

Select inputs **170*p* and 170*s* of multiplexer 170 are connected to Vdd and a lead 172, respectively. Select inputs 171*p* and 171*s* of multiplexer 171 are connected to leads 173 and 174**, respectively.

As will be shown hereinafter, the display control logic circuits 44 respond to timing pulses Q1 and Q2, provided by the timing pulse generating circuits 34, to supply digit enable signals over lead 172–174 which effect the display of tenths, units and tens digits, respectively. When lead 172 is high, or at logic 1 level, multiplexer 170 is enabled to output the tenths digit data word to the display decoder 40. When lead 173 is high, multiplexer 171 outputs the units digit data word to multiplexer 170 which extends such data word to the display decoder 40. Also, when the line 174 is high, multiplexer 171 outputs the tens digit data word to multiplexer 170 which extends the data word to the display decoder. The display decoder 40 is enabled to respond to a data word supplied to data inputs 169A–169D thereof whenever its enabling input $\overline{BL}$ is high in response to a signal provided over lead 175 by the display control logic 44. When enabled, the display decoder 40 decodes the four bit data word supplied thereto and provides enabling signals over seven segment select outputs **169*a*–169*g* which are connected over resistors 169*a*'–169*g*' to segment inputs of the display unit 20**.

A decimal point drive circuit including a two input AND gate 182, and associated current limiting resistor **182*a*, effect energization of decimal point segment 176' of the display unit, which is located between the tenths and units digits. Gate 182 is primed when the display switch 16 is operated "on". Gate 182 is enabled in response to a signal provided over leads 173' and 183 by the display control logic circuits 44 to extend an enabling signal to a decimal point input at pin 6 of the display unit 20**.

Digit common cathode ground driver circuits 184, shown in FIG. 6, for the LED devices 176–178 include transistors 179–181 which are selectively enabled by signals provided over leads 172'–174' by the display control logic circuits 44 to extend ground to the cathodes of the LED segments for tenths, units and tens digit devices 176–178 respectively.

Referring to FIG. 3, the display control logic circuits 44 include digit select gates 185, having three two-input AND gates 186–188, which select tenths, units and tens digits respectively. Tenths gate 186 is enabled by timing pulses Q1 and $\overline{Q2}$ to provide a logic 1 level output which is extended over lead 172 for enabling multiplexer 170, and over lead 172' for enabling ground driver transistor 179. Such output is also extended over an OR gate 191 to one input of a two input AND gate 192 which has its other input connected over lead 193 to the switch arm 141 of the display switch 16, which primes gate 192 when the switch 16 is operated "on". The output of gate 192 is connected over lead 175 to the enabling input $\overline{BL}$ of the display decoder 40.

Units gate 187 is enabled by timing pulses Q2 and $\overline{Q1}$ to provide a logic 1 level output which is extended over lead 173 for enabling multiplexer 171, and over lead 173' for enabling ground driver transistor 179.

The output of gate 187 is also gated with a signal, representing that the tens or units digit is not zero, provided by an OR gate 198 in response to outputs of the digit zero decoder 39. The decoder 39, shown in FIG. 4, may be an RCA Type 4072 CMOS decoder. The decoder 39 receives the units data word over inputs **39*e*–39*h* which are connected to lead sets 113" which are multipled with lead sets 113 at the outputs of the counter 109. The tens data word is supplied to inputs 39*a*–39*d* of the decoder 39 over lead sets 114" which are multipled with lead sets 114 at the outputs of counter 110. The decoder 39 has outputs 39*j* and 39*k* connected to inputs of gate 198, the output of which is connected to an input of two input AND gate 194 which has its other input connected to lead 173. Whenever the tens or units digits are not zero, the decoder outputs 39*j* and 39*k* are at logic 1 levels, gating the output of the gate 187 to gate 191 for enabling the diplay decoder 40. When the tens and units digits are both zero, gate 198 inhibits gate 194**, preventing display of the units digit.

Referring to FIG. 3, the tens gate 188 is enabled by timing pulses Q1 and Q2 to provide a logic 1 level output which is extended over lead 174 for enabling the multiplexer 171, and over lead 174' for enabling ground driver transistor 179. The output of gate 188 is also gated with output **39*j* of decoder 39 by AND gate 196 for controlling gate 191** to prevent the display of the tens digit when zero.

Timing Pulse Generating Circuits

The timing pulse generating circuits 34 shown in FIGS. 3 and 5, include an oscillator circuit 200, a pulse divider circuit 201 and four monopulsers 202–205. The oscillator circuit 200 is operable when enabled to provide timing pulse outputs at a frequency of 113.77 Hz which is counted down by the pulse divider circuit 201 to provide timing pulses over outputs Q1–Q12 thereof.

Pulses provided over output Q1 are extended to monopulser 202 which provides pulses to chip enable input $\overline{CI}$ of the memory 32. Output Q1 is also extended to monopulser 203 which is connected in tandem with monopulser 204 and operable in effect to provide a delayed timing pulse Q1' for sequencing the transfer of data words between the memory 32 to the counters 107–110 via buffer registers 36 and 37. The timing pulses provided over outputs Q2–Q5 are extended to the memory select inputs A0–A4 providing pulses for reading the data out of the memory 32 or writing data into the memory at the locations designated by the address select switches 18. Timing pulses at output Q6 are supplied to the read/write latch 131 of the control logic 43 to control the selection of the read/write modes for the memory 32, and to monopulser 205 which controls the output control latch 132 for loading data words into buffer register 37. Timing pulses Q1 and Q2 are also extended to the display control logic 44 to control the display of the tens, units and tenths digits of the LED display unit 20. Timing pulses at output Q12 are extended to the counter 107 for incrementing the counter 107 during a timing operation.

More specifically, the oscillator circuit 200 comprises a solid state timer circuit 208 and an enabling circuits 209 which responds to operation of the timer switch 15 or display switch 16 to enable the timer circuit 208. The timer circuit 208, which may be the Signetics Type NE555 timer circuit, has an external timing network 210 which establishes the 113.777 Hz output frequency for the oscillator circuit 201. A resistor 211 of network 210 serves as a frequency trimmer.

The enabling circuit 209 includes a transistor 212 having its base connected to the junction of resistors 213–214 which are connected between the output of function select gate 133 and ground, forming a voltage divider network at the base of transistor 212. Transistor 212 has its collector connected to Vdd and its emitter connected to a power input at pin 4 of the timer circuit 208, and to the external timing network 210.

Transistor 212 is normally non-conducting and is rendered conductive to extend Vdd to the timer circuit 208 in response to the enabling of gate 133 following operation of timer switch 15 or display switch 16 to the "on" position. The timer circuit 208 is operable when energized to provide the signal at a frequency of 113.777 Hz, or 8.8 millisecond period, at its output pin 3, which is connected over lead 214 to the input of the divider circuit 201, shown in FIG. 3.

The divider circuit 201 may be the Motorola Type 4040 CMOS pulse divider, which provides a divide by 4096 function, providing a signal at output Q12 at the rate of one pulse every thirty-six seconds which is used to increment the counter 107. Also, timing pulses provided at outputs Q1–Q6 are employed to synchronize memory read/write cycles and data transfer operations. As indicated, the approximate basic oscillator rate is 8.8 milliseconds. Such approximate rate is scaled by factors of two to provide timing pulses Q1–Q12. Timing pulse Q1, which is provided at a 17.6 millisecond rate, provides the clock frequency for the recorder circuits, and timing pulse Q2, which is provided at a 35.2 millisecond rate, is used along with timing pulse Q1 to sequence the digit select gates 185 of the display control logic circuits. Timing pulses Q3–Q5, which are provided at respective rates of 70.4, 140.8, and 281.6 milliseconds, along with timing pulse Q2 sequence memory read/-write operations. Timing pulse Q6, which is provided at approximately 0.5632 second rate, control the read/-write modes for the memory.

Figures 6, 7:
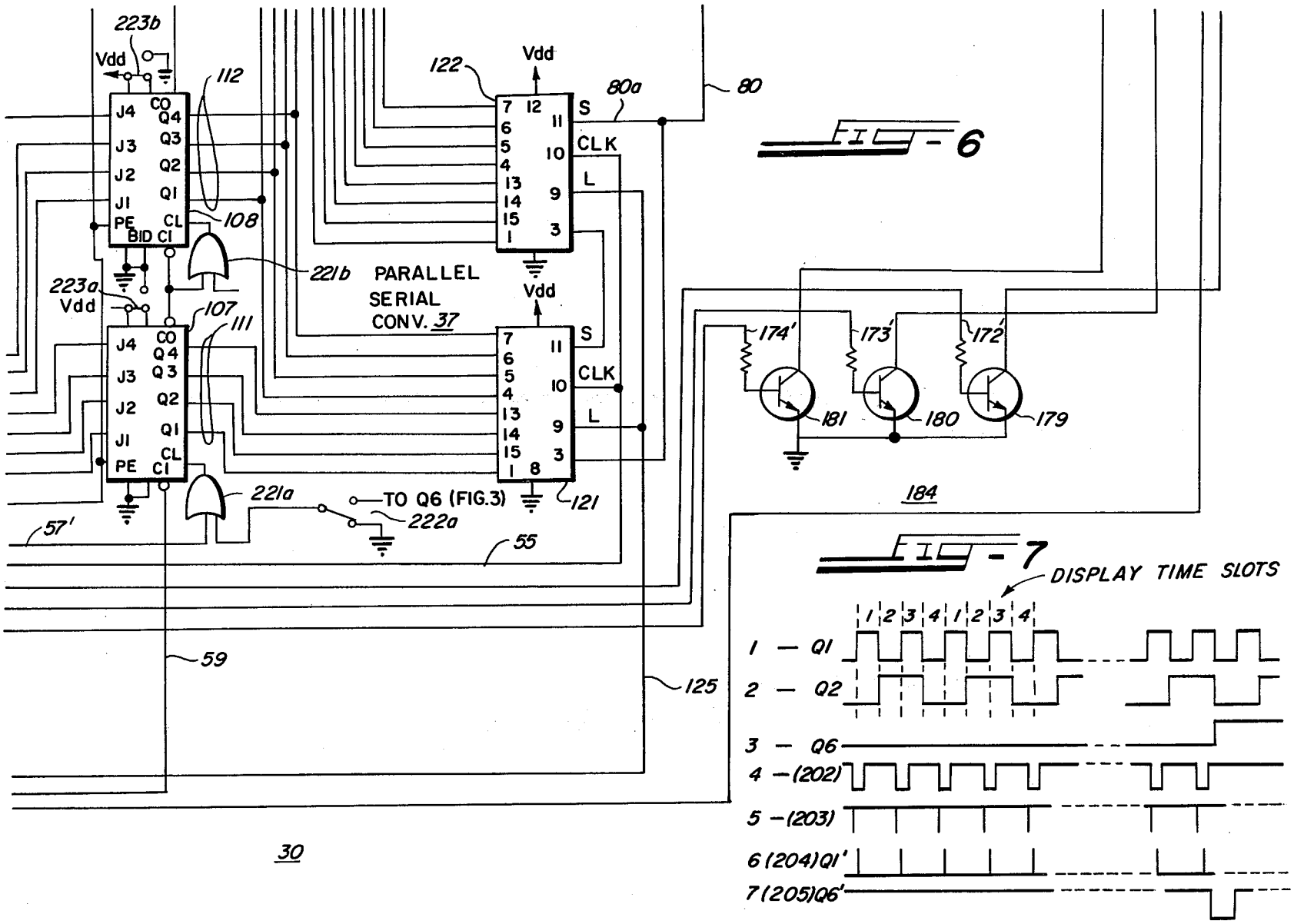
FIG. 7 is a timing chart showing the relation between timing pulses and control pulses provided by the recorder circuits.

The monopulsers 202–205 may each comprise half section of the Motorola Type 4528 Dual CMOS Monostable circuit. Each monopulser has an associated external timing network, such as network 216 for monopulser 202 which establishes the width of the output pulse provided by the circuit. A timing diagram provided in FIG. 7, shows the outputs provided by the four monopulser circuits 202–205 in relation to timing pulses Q1, Q2 and Q6.

Monopulser 202 responds to each timing pulse Q1 (FIG. 7, line 1) to deliver a negative going pulse of approximately 3 microsecond duration (FIG. 7, line 4) to the chip enable input of the memory.

Monopulser 203 responds to each timing pulse Q1 to deliver a negative going pulse of approximately 1 microsecond duration to an input of monopulser 204 which responsively provides a positive pulse (FIG. 7, line 6) to lead 55. The pulse output of monopulser 204, designated as Q1′, is provided at the same rate as timing pulses Q1. Pulses Q1′ are used as the clock signal for the buffer registers 36 and 37 and the counter circuits 107–110. Also, as is shown in FIG. 7, pulses Q1′ are provided at approximately the midpoint of the chip enable signals provided by monopulser 202, assuring that each data bit read out of memory is loaded into the serial data input of the serial-to-parallel converter 36 at its midpoint.

Monopulser 205 responds to each timing pulse Q6 (FIG. 7, line 3) to provide a negative going pulse Q6′ (FIG. 7, line 7) which sets the output control latch 132 of the control logic 43. The latch 132 is then reset by the next timing pulse Q2.

With reference to FIG. 7, lines 1 and 2, timing pulses Q1 and Q2 provide four time slots defining an enabling cycle for the digit select gates 185. As shown in FIG. 7, the tenths, units, and tens gates 186–188 are enabled in respective time slots 1–3 and gates 186–188 are all disabled in the fourth time slot, providing a seventy-five percent duty cycle.

Operation

With reference to FIGS. 3–6, when the timer and display switches are "off", the recorder unit 10 is in the standby mode, with function select gate 133 disabled so that the oscillator circuit 200 is inhibited, and the pulse divider circuit 201 is held in a reset state by the logic 1 level signal supplied over inverter 146 and lead 147 from gate 133 to its reset input. Assuming that the address select switches **18*a* and 18*b* are set to provide the coding for memory storage locations A8, the memory 32** is prepared to readout the data words, which are stored at the locations corresponding to such address.

Timing Operation

In response to the operation of the timer switch 15, the function select gate 133 is enabled, providing a logic 1 level over head 145 to enable transistor 212. Thus, the timing circuit 208 is energized and operates to provide output signals at the 113.777 Hz rate over lead 214 to the pulse divider circuit 201. Also, the logic 1 output of gate 133, as extended over inverter 146 and lead 147, releases the pulse divider circuit 201, enabling the pulse dividing circuit 201 to count down the 113.777 Hz frequency to provide timing pulses Q1–Q12. Further, the signal Vdd provided on switch arm 136 of switch 15 is extended over inverter 139 and lead 59 to the input CI of counter 107 for enabling the counter 107 to respond to incrementing pulses Q12.

Each timing pulse Q1 enables monopulser 202 to deliver a three microsecond pulse (FIG. 7, line 4) to the chip enable input of the memory 32 for enabling the timing pulses Q2–Q5 to provide serial readout of the sixteen data bits stored at memory locations A8. The data bits read out are extended over conductor 81 to the serial-to-parallel converter 36.

The monopulser 203 is driven at the Q1 rate for enabling monopulser 204 to provide a delayed clock pulse Q1′ (FIG. 7, line 6) over lead 55 for loading the serial data into the serial-to-parallel converter 36. The false output of the read/write latch 131, which is high, enables gate 115 to gate the Q1′ clock pulse on lead 55 to the counters 107–110, which are set to initial counts represented by the four data words read out of the meory 32, such data words then appearing on lead sets 111–114 at the output of the counters 107–110.

When timing pulse Q6 is provided by pulse divider 201, such pulse, as extended via inverter 153 to gate 151, sets the read/write latch 131 to transfer from memory operation read to write cycles, and to inhibit gate 115, preventing passage of clock pulses Q1' to the counters 107–110. Also, the leading edge of timing pulse Q6 enables monopulser 205 which delivers pulse Q6' (FIG. 7, line 7) to gate 158, setting the output control latch 132. When set, the true output of control latch 132, causes the data words at outputs of the counters 107–110 to be jammed into the parallel-to-serial converter 37.

The next timing pulse Q2 extended over inverter 161 resets the output latch 132, enabling the parallel-to-serial converter 37 to respond to clock pulses Q1' to output the data serially to the memory data input DI over lead 80. The data bits are also circulated through the parallel-to-serial converter 37 via lead 80*a*.

The data provided at memory data input DI is written into the memory at locations A8 under the control of timing pulses Q2–Q5 and the pulses at the Q1 rate provided by monopulser 202. The output control latch 132 is thereafter alternately set and reset at the Q6 rate, that is, approximately each half second, to refresh the parallel-to-serial converter with the contents of the counters 107–110 and enable the data to be written back into the memory.

When the first timing pulse Q12 is provided, the pulse is extended over lead 57 and inverter 69 to the clock input of counter 107, which is stepped by a count of one effectively adding 36 seconds to the value of elapsed time, stored by the counters 107–110. The timing operation continues with the counter 107 being stepped a count of one every 36 seconds, and the data words being written into memory at approximately half second intervals, as long as the timer switch 15 remains in the "on" position.

The timing operation is terminated when the timer switch 15 is operated to the "off" position. If timer switch 15 is operated "off" while timing pulse Q6 is low, then gate 133 is inhibited, and its output goes low, causing the enabling circuit 209 of the oscillator 200 to inhibit the timing circuit 208 so that no further 113.777 Hz pulses are supplied to the pulse divider circuit 201. Also, the output of gate 133 causes the read/write control latch 131 to be reset transferring the memory from the write to read modes, and via inverter 146 resets the pulse divider circuit 201. Also, the enable input for counter 107 is removed from lead 59. Thus, the recorder unit 10 is now in the standby mode, and is prepared for a subsequent timing or display operation. Also, at such time, the data words stored at memory locations A8 correspond to the elapsed time recorded by the counters 107–110. It is pointed out that if the timer switch 15 is operated "off" while timing pulse Q6 is true, such pulse maintains gate 133 enabled, allowing continued timing pulse generating until timing pulse Q6 becomes false. At such time, the recorder circuits assume the standby mode as described above.

Display

For a display operation, when the display switch 16 is operated to the "on" position, the oscillator circuits 200 and the pulse divider circuit 201 are enabled as described above, causing the data words stored at the memory locations A8 to be read out and transferred to the counter 107–110 via serial-to-parallel converter 36. The read/write latch 131 is set when timing pulse Q6 is provided, at which time memory operation is transferred to the write mode. The output control latch 132 is also set by pulse Q6' to cause the data words provided at outputs of counters 107–110 to be jammed into the parallel-to-serial converter 37, allowing the data to be written back into the memory under the control of the timing pulses Q1', when latch 132 is thereafter reset.

Timing pulses Q1 and Q2 enable the display control logic circuits 44 to effect the display of the three digits representing tens, units and tenths of hours. With reference to FIGS. 3, 4, and 7, when timing pulse Q1 (FIG. 7, lines 1 and 2) is provided in the first display time slot, that is, when Q2 is false, tenths digit gate 186 is enabled providing a logic 1 output which is extended over gate 191 to an input of gate 192 for enabling gate 192 which is primed by an enabling input supplied over lead 193 from the display switch 16. Thus, gate 192 provides an enabling signal to the enabling input of the display decoder circuit 40. The display decoder circuit 40 is thus prepared to respond to digit data supplied to its data inputs 169A–169D to provide segment select signals for the display unit 20 over outputs 169*a*–169*g*.

The output of gate 186 is also extended over lead 172 to enable multiplexer circuit 170 to extend the tenths digit data word provided on lead set 112 to the data inputs 169A–169D of the display decoder 40. The output of gate 186, as extended over lead 172', also enables gate 182, and enables transistor 179 which connects ground to the cathodes of the tenths digit segment 176. Accordingly, the segments of the hundredths digit selected by the display decoder 40 and the decimal point segment are energized.

The units digit gate 187 is enabled in the second display time slot, when timing pulse Q1 is false and pulse Q2 is true (FIG. 7, lines 1 and 2). The logic 1 level provided on lead 173 when gate 187 is enabled causes multiplexer 30 to extend the data word representing the units digit to the display decoder 40 and, as extended over lead 173', enables transistor 180 to connect ground to the segments of the units digit. Also, assuming the units digit is not zero, gate 194 is enabled, providing a logic 1 level output which is extended over gates 191 and 192 to enable the display decoder 40 to provide segment select signals for the display unit 20 for energizing the appropriate segments of the units digit 177.

Thereafter, in display time slot three, when both timing pulses Q1 and Q2 are true, the tens digit gate 188 is enabled causing selection of the data word representing the tens digit, and enabling the tens digit ground cathode driver transistor 181. Also, when the tens digit is not zero, gate 196 is enabled, providing an output which is extended over gates 191 and 192 for enabling the display decoder to respond to the tens digit data word to energize appropriate segments of the tens digit 178.

During the display time slot four, when both pulses Q1 and Q2 are false, the digit select gates 186–188 are inhibited. The persistance of the eye enables continuous display of the three digit indication of elapsed time as long as display switch 16 is operated "on".

The sequence of operations indicated above continues, with gates 186–188 being sequentially enabled to effect the display of the three digit representation of elapsed time data until the display switch 16 is operated "off".

When the display switch 16 is operated "off", gates 182 and 192 are inhibited, preventing the application further drive signals to the display unit 20. Also, the recorder circuits are placed in the standby mode as described above for the timing operation with the oscillator circuit 200 being disabled, the pulse counting circuits 201 and the read/write latch 131 being reset.

Clear Operation

For a clear operation, the clear switch 17 is held operated, causing a reset signal to be provided over lead 116 to the reset inputs of the shift registers 105 and 106 which comprise the serial-to-parallel converter 36. Accordingly, the registers 105 and 106 are constrained to store all zeros regardless of data on their inputs. Then, the display switch 16 is operated, effecting a display operation as described above. However, the data loaded into the counters 107–110 initializes the counters to a count of zero, and such data is written into the memory at the location designated by the select switches 18.

Presettable Count Down

As described above, for timing operations, the counters 107–110 are incremented from zero or some initial value to record elapsed time, In some instances, it is desirable to allocate a fixed amount of working time to any given project, and to provide an indication when such time is up. For such cases, the recorder unit can be set to operate in a count down mode in which the counters 107–110 are preset to initial counts representing the allocated time, and are then decremented to a count of zero by clock pulses Q12 at the thirty-six second rate. When the count becomes zero, a suitable indicator is enabled.

More specifically, the counting circuits 35 comprise the RCA Type CD4029 decade counters, which are presettable up/down counters. The counters 107–110 are normally set for count up operation by switches 223, such as switch **223*a* for counter 107, which connects Vdd to the up/down input at pin 10. The switches 223 are operable to connect ground to pin 10, setting respective counters for count down operation. The counters 107–110 are preset by gating clock pulses at the rate of timing pulse Q6 into the counters by way of OR gate 221, such as gate 221*a* for counter 107**.

Gate **221*a* has an input connectable over a switch 222 to the Q6 output of the pulse divider circuit 201 (FIG. 3). The switch 222 normally connects ground to such input of the gatee 221*a* which has a second input connected over inverter 69 to the Q12 output of the pulse divider circuit. When switch 222 is operated, the corresponding counter stage 107 is stepped at the Q6 rate. Likewise, gates 222*b*–222*d*, which are associated with respective counters 108–110** each have inputs connectable over switches (not shown) to the Q6 output of the pulse divider circuit.

To preset stages 108–110, which correspond to tenths, units and tens of hours, switches 223 are set to connect Vdd to the up/down inputs, and the display switch 16 is operated on. Then counter stages 108–110 are incremented one at a time by pulses at the Q6 rate, while observing the count of each stage on the display unit 21 until the desired count in reached.

Alternatively, the counter stages may be incremented to initial values by supplying ground level pulses to the clock inputs of the counter stages, which are normally high, through the use of manually operable switches (not shown). For such operation, the carry input of the counter stage 107 is maintained high through the use of an additional switch. Also, suitable contact bounce protection circuits may be used as is known in the art.

It is pointed out that in the exemplary embodiment, the state of the hundredths counter 107 is not displayed. Thus, the tenths display and the tenths counter 108 are used to assist in presetting the hundredths counter 107 prior to the setting of the tenths counter to its initial value. This is accomplished by operating switch 222 to increment counter 107 while observing the tenths digits on the display unit 21. When the hundredths counter 107 reaches a full count, and is thus set to zero, the tenths counter 108 is stepped by a count of one, and this can be observed on the display.

If it is desired that the hundredths counter 107 be set to zero, then the tenths, units and tens counters can be set as described above while the hundredths counter, which is now set to zero, is left alone.

If it is desired to set the hundredths counter 107 to a count other than zero, then once the hundredths counter has been set to zero, as described above, then switch 222 and the switch associated with gate **221*b* are operated simultaneously (after the tenths counter has first been set to zero), and the counters 107 and 108 are incremented simultaneously while observing the tenths digit displayed on the display 21. When the desired count for the hundredths counter is reached, the switches are released and the hundredths counter 107 is set to its desired value. The tenths, units and tens counters 108–110** in that order, are then set to the desired value as described above.

Once the counters 107–110 have been preset, then the switches 223 are operated to place the counters in the count down mode, and the timing switch 15 is operated, causing the counters to be decremented to a count of zero by timing pulses at the Q12 rate. When the counters 107–110 have been decremented to a count of zero, a suitable indicator 225, which is driven from the carry output of the counter 110 is enabled to indicate that the allocated time has expired.

Hard Copy Readout

Figure 8:
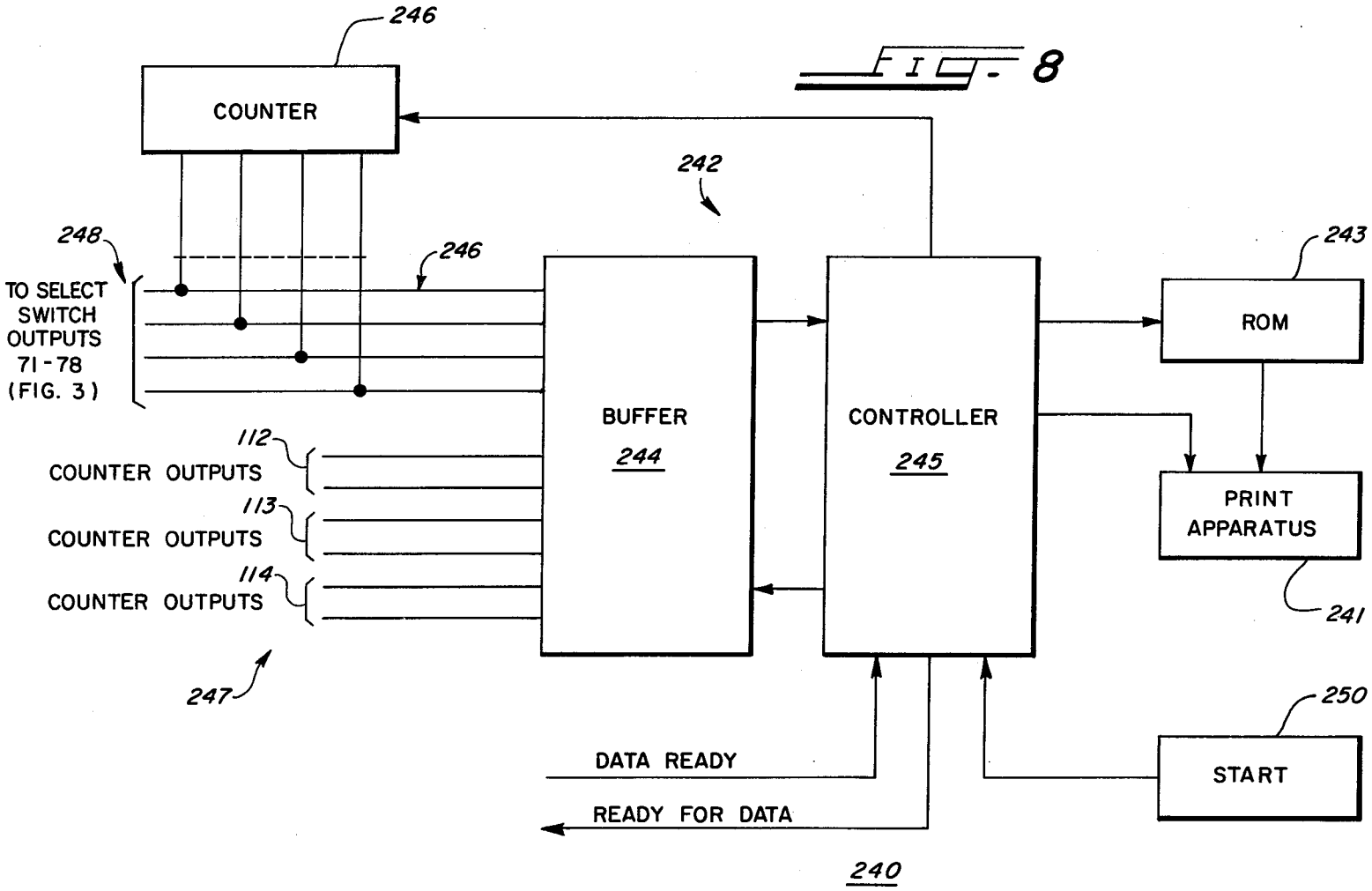
FIG. 8 is a simplified block diagram of an illustrative embodiment for an accessory unit which may be used to provide hard-copy readout of the information stored in the memory of the recorder unit; and, FIG. 9 shows how

As indicated above, time information relating to each job function can be read out by displaying the cummulative elapsed time for each project and logging the displayed time information. Alternatively, the time information can be read out of the memory 32 automatically, using an accessory unit 240, shown in block diagram form in FIG. 8, which enables the sequential readout of the set of data words at each addressable memory storage location.

The accessory unit 240 includes a memory sequencer 246 which sequentially addresses the memory storage locations, effecting readout of the data words stored at such locations. Each set of data words read out of the memory 32 is supplied over suitable interface circuits 242 to a printing apparatus 241, which prints out the elapsed time information in numerical form. The address code is also printed next to the corresponding elapsed time data. A zero suppression circuit may be used to eliminate useless data.

By way of example, the printing apparatus 241 may comprise a dot matrix printer, such as the Model 7040 Series Printer, commercially available from C. Itoh Electronics, Inc. and suitable print solenoid drivers, a motor control circuit, and a power supply circuit.

The interface circuits 242 include a buffer register 244 which receives and temporarily stores data indicating the addressed location and data providing the coding for the three data words stored in the counter stages 108–110, representing the coding for tenths, units and tens of hours. The interface circuits 242 also include a read only memory (ROM) 243 which stores character formation pattern data for each of the characters to be printed. In the exemplary embodiment, where it is assumed that the memory 32 has a 256 word storage capability and that all eight lines 71–78 of the memory select switches 18 are used, sixteen letters A-P, ten numbers 0–9 and a decimal point have to be printed. Also, the dot matrix characters are assumed to be in a seven by five pattern. Accordingly, a 945 bit ROM memory is required, and so a conventional 1024 bit memory, such as the Type 93427 PC, commercially available from Fairchild Semiconductor, is used.

The interface circuits 242 further include a controller unit 245 which is enabled to response to the operation of a start print switch 250 to provide timing signals for synchronizing the operation of the memory sequencer 246, the buffer register 244 and the printing apparatus 241. The controller 245 also responds to data stored in the register 244 to effect readout of the character formation patterns from the ROM 243.

The use of a dot matrix printing apparatus and control thereof by outputs of a character formation pattern memory and a sequencer or controller is well known in the art. Thus, the elements of the accessory unit will not be described in detail.

The controller 245 may include a flip flop (not shown) which is set in response to operation of the start print switch 250 to initiate a print cycle. To effect readout of stored data, the controller provides an output over lead Ready For Data which is connectable to a fourth input of gate 133 (FIG. 5) which for this application would be a four input OR gate, with the fourth input normally grounded. When enabled, gate 133 effects the start of a display operation similar to that provided by operation of the dispaly switch 16. However, lead 143 (FIG. 5) remains grounded by the display switch 16, thereby inhibiting the display unit 21.

The memory sequencer 246 may comprise a counter having outputs 248 connectable to the memory select switch lines 71–78 (FIG. 3) to control memory address sequencing. Such outputs 248 are also connected to inputs 246 of the buffer register 244 which has further inputs 247 connectable to the data outputs 112–114 of counter stages 108–110 (FIGS. 4 and 6). The memory sequencer 246 is operable under the control of the controller 245 to increment the select lines 71–78 by providing digitally coded signals over outputs 248 to select each memory address in sequence causing readout of the data stored thereat. When the data is provided to the counters 108–110, a signal, such as timing signal Q6 provided by the accumulating timer unit 10 over a lead Data Ready enables the controller 245 to effect the transfer of data from the register 244 to select inputs of the ROM 243 which responsively provides coded outputs to the printing apparatus 241 representing character forming patterns for the data to be printed. The controller also supplies a control input to the printing apparatus to effect the column spacing between characters as is known in the art. Further, the controller 245 removes the enabling signal from the lead Ready For Data, thereby inhibiting gate 133 terminating the current "read cycle" and causing the reset of the timing circuits of the timer unit 10. The time information remains latched in the counters 107–110.

At the end of a predetermined time defined, for example, by the status of print switches of the printer 241 or by a timer of the controller unit 245, indicative that the printing of a row of information has been completed, the controller increments the memory sequencer 246 which outputs the address of the next memory location, and the controller again provides an enabling signal on lead Ready For Data, causing the timer unit 10 to effect a further read cycle and supply the data to the inputs of the buffer register 244 for use in the next print operation.

The connections of the data and control lines of the accessory unit 240 to the accumulating timer unit 10 may be effected through the use of a suitable multi-terminal connector (not shown).

To obtain a hard copy readout of the data stored in the memory 32 of the accumulating timer unit 10, the accessory unit is connected to the accumulating timer unit and the select switches 18A and 18B are set to positions indicating location A1. This places a ground or logic 0 level on output lines 71–78 since the memory sequencer is reset to zero. Then the start print switch 250 is operated setting the controller start flip flop enabling the controller to initiate a printing cycle. The controller 245 provides an enabling signal over lead Ready For Data which enables gate 133 initiating a normal display cycle except that the display unit is blanked out. Accordingly the timing pulse generator 34 is enabled, causing the data stored at location A1 to be loaded into the counters 107–110 in the manner described above, with the data words stored in stages 108–110 also appearing at inputs 247 of the buffer register 244.

When signal Q6 is provided on lead Data Ready, the controller loads the data into the register, and the operation is transferred from the timer unit to the controller which removes the enabling signal from gate 133, terminating the current display operation causing reset of the timing pulse generator 34. The controller then presents first the address word and then the tens, units and tenths digits data words in sequence to the ROM. The address is located and the seven by five matrix is clocked through with timing proper for the printer. When a line has been printed, as indicated by print switch status, for example, the memory address sequencer is incremented by one and control is transferred back to the timer unit 10 via lead Ready For Data. The data stored at the next memory address is read out, and the controller initiates printout of the next row of data.

The controller 245 includes suitable gating circuits (not shown) for zero suppression whereby whenever the hours data is all zero for any memory location, data transfer to the ROM and the print cycle are aborted and the controller immediately increments the memory sequencer by one and returns control to the timer unit 10.

The cycle continues as described above and when all of the data has been read out and printed, the carry output of the sequencer counter comes true, causing reset of the controller start flip flop so that the controller 245 terminates the printing operation.

We claim:

1. In a time recording apparatus for providing a record of elapsed time for each of a plurality of different functions, the combination comprising: data processing means operable when enabled to provide elapsed time data, enabling means operable to enable said data processing means for a time interval during which elapsed time is to be recorded for one of said functions, said data processing means including timing means for providing timing pulses at a predetermined rate, and pulse counting means for counting said timing pulses during said time interval to provide said elapsed time data, data storage means having a plurality of individually addressable data storage locations, including a separate data storage location corresponding to each of said functions, select means manually operable to generate signals for selecting the data storage location for a function for which elapsed time is to be recorded, data transfer means for transferring data at the selected data storage location to said pulse counting means at the start of said time interval to preset said pulse counting means to a count representing elapsed time previously recorded for the corresponding function, whereby the data provided by said pulse counting means at the end of said time interval represents cummulative elapsed time for said function, and means for permitting the cummulative elapsed time data provided by said data processing means to be stored at said selected data storage location.

2. A recording apparatus as set forth in claim 1 wherein said timing means provides timing pulses at a rate of one pulse every thirty seconds, said pulse counting means providing elapsed time data representing tens, units, tenths and hundredths of hours.

3. A recording apparatus as set forth in claim 1 wherein said pulse counting means comprises an up/-down counter, and wherein said enabling means includes means for permitting said pulse counting means to be preset to a predetermined count, and to be decremented by said timing pulses to a count of zero, and means responsive to said pulse counting means reaching a count of zero to provide an indication.

4. A recording apparatus as set forth in claim 1 which includes readout means having means for effecting sequential readout of the elapsed time data stored by said data storage means at each of the data storage locations thereof, and means responsive to the elapsed time data read out of said data storage means to provide a numerical printout of the elapsed time data.

5. In a time recording apparatus for providing a record of elapsed time for each of a plurality of different functions, the combination comprising: data processing means operable when enabled to provide elapsed time data, enabling means including timer switch means operable to enable said data processing means for a time interval during which elapsed time is to be recorded for one of said functions, said data processing means including timing means for providing timing pulses at a predetermined rate, and pulse counting means for counting said timing pulses during said time interval to provide said elapsed time data, data storage means having a plurality of individually addressable data storage locations, including a separate data storage location corresponding to each of said functions, select switch means manually operable to select the location for said one function for which elapsed time is to be recorded, said data processing means further including data transfer means for transferring data at said selected data storage location to said pulse counting means at the start of said time interval to present said pulse counting means to a count representing elapsed time previously recorded for the corresponding function, whereby the data provided by said pulse counting means at the end of said time interval represents cummulative elapsed time for said function, means for permitting the cummulative elapsed time data provided by said data processing means to be stored at said selected data storage location, and display means operable when enabled to provide a numerical indication of data provided by said data processing means.

6. A recording apparatus as set forth in claim 5 wherein said data storage means comprises a solid state memory selectively operable in read and write modes, and wherein said enabling means includes means controlled by said timing means for selecting the operating mode for said memory means.

7. A recording apparatus as set forth in claim 6 wherein said timing means provides further timing pulses at a faster rate than said predetermined rate for controlling said data transfer means and said memory means.

8. A recording apparatus as set forth in claim 5 wherein said enabling means includes means for controlling said data transfer means for clearing the data stored at a data storage location selected by said select switch means.

9. A recording apparatus as set forth in claim 5 wherein said display means includes a display unit, and display control means, and wherein said enabling means includes display switch means manually operable to effect the transfer of elapsed time data stored at a location selected by said select switch means to said display control means, said display control means being responsive to further timing pulses provided by said timing means and to said elapsed time data to control said display unit to provide said numerical indication.

10. A recording apparatus as set forth in claim 5 which obtains power from a battery.

11. A recording apparatus as set forth in claim 5 which includes readout means having means for effecting sequential readout of the elapsed time data stored by said data storage means at each of the data storage locations thereof, and means responsive to the elapsed time data read out of said data storage means to provide a numerical printout of the elapsed time data.

12. In a time recording apparatus for providing a record of elapsed time for each of a plurality of different functions, the combination comprising: enabling means including first switch means manually operable to define the beginning and the end of a time interval during which elapsed time is to be recorded for a given one of said functions, and control means enabled by said first switch means at the start of said time interval to provide first and second control outputs, data processing means including timing means responsive to said second control output to count first timing pulses provided by said timing means to provide elapsed time data representing the duration of said time interval, data storage means having a plurality of data storage locations, including a separate data storage location corresponding to each of said functions for storing data representing elapsed time recorded for each function, select switch means manually operable for selecting the data storage location corresponding to the function for which elapsed time is to be recorded, data transfer means interposed between said data storage means and said pulse counting means for transferring data stored at said selected data storage location to said pulse counting means at the start of said time interval to preset said pulse counting means to a count representing the elapsed time previously recorded for the corresponding function whereby the elapsed time data provided by said pulse counting means at the end of said time interval represents cummulative elapsed time for said function, and output means responsive to said timing means for causing the elapsed time data provided by said pulse counting means to be stored at the selected location of said data storage means.

13. A recording apparatus as set forth in claim 12 wherein said data storage means comprises a solid state memory means selectively operable in read and write modes, and said control means including read/write means for causing said memory means to be operable in a read mode at the start of said time interval to permit the data stored at said selected data storage location to be provided to said data transfer means, said read/write means being responsive to a control output provided by said timing means at a predetermined time after the start of said time interval to cause said memory means to be operable in a write mode to permit data provided by said pulse counting means to be written back into said memory means at said selected data storage location.

14. A recording apparatus as set forth in claim 13 wherein said elapsed time data for each of said functions comprises a plurality of multibit data words, and each data storage location comprises a block of bit storage locations, and wherein said select switch means has a plurality of outputs connected to select inputs of said memory means, said select switch means providing binary coded output signals for selecting the bit locations of a given data storage location.

15. A recording apparatus as set forth in claim 14 wherein said select switch means comprises at least first and second thumbwheel switches.

16. A recording apparatus as set forth in claim 14 wherein said pulse counting means comprises a multistage counter having a separate stage for each of said multibit data words, said counter stages having parallel inputs and parallel outputs, said data transfer means including serial-to-parallel register means for receiving serial data provided over an output of said memory means and providing parallel data to said parallel inputs of said counter, and said output means including parallel-to-serial register means for receiving parallel data provided at said parallel outputs of said counter and providing serial data to an input of said memory means.

17. A recording apparatus as set forth in claim 16, further including display means operable when enabled to provide a numerical display of elapsed time data stored at a data storage location selected by said select means, said enabling means further including display switch means manually operable to enable said display means.

18. A recording apparatus as set forth in claim 13 wherein said timing means comprises oscillator means operable when enabled to provide signals at a predetermined frequency, and frequency divider means responsive to said signals for providing said plurality of timing pulses, including said first timing pulses.

19. A recording apparatus as set forth in claim 18 wherein said timing means includes first means responsive to second timing pulses provided by said frequency divider means to provide clock pulses for synchronizing the transfer of data between said memory means and said pulse counting means, and second means responsive to third timing pulses of said plurality to provide said control output for said read/write means.

20. A recording apparatus as set forth in claim 18 wherein said control means includes output control means operable when enabled to permit elapsed time data provided by said pulse counting means to be provided to said output means, said timing means including third means responsive to said third timing pulses to periodically enable said output control means to cause data provided by said pulse counting means to be written back into said memory means periodically during said time interval.

21. A recording apparatus as set forth in claim 12 which includes readout means having controller means for causing said timing means to read out the data at the selected data storage location, sequencer means responsive to said controller means for selecting each data storage location in sequence, and means for receiving the data as it is read out of the data storage locations and for providing inputs to a printing means to effect the printout of the data on a medium.

22. In a time recording apparatus for timing different periods of activity for each of a plurality of different functions and for providing a record of cummulative elapsed time for activity periods for each of the functions, the combination comprising: data storage means having a plurality of individually addressable data storage locations, including a separate data storage location corresponding to each of said functions for storing a set of coded data signals representing elapsed time data recorded for the corresponding function, select means operable to generate select signals for selecting the data storage location corresponding to a given function for which an activity period is to be timed, start means manually operable to define the beginning and the end of a time interval which corresponds to the duration of the activity period, control means including timing means responsive to said start means for generating timing signals to effect the readout of the data signals stored at the selected data storage location at the beginning of said time interval, signal processing means including data transfer means for receiving the signals read out of said data storage means, said signal processing means being responsive to the data signals read out of said data storage means and to further timing signals generated by said timing means during said time interval to generate a further set of data signals coded to represent cummulative elapsed time for said function including the total elapsed time for activity periods previously recorded for said given function, as represented by the data signals read out of said data storage means, and the time elapsed during said time interval, and said data transfer means being responsive to said control means to transfer said further data signals from said signal processing means to said data storage means for storage at said selected data storage location.

* * * * *

UNITED STATES PATENT AND TRADEMARK OFFICE

CERTIFICATE OF CORRECTION

PATENT NO. : 4,195,220

DATED : March 25, 1980

INVENTOR(S) : Stanley M. Bristol et al

It is certified that error appears in the above—identified patent and that said Letters Patent is hereby corrected as shown below:

In Claim 2, line 3, after "thirty", insert -- -six --.

Signed and Sealed this

*Twenty-first* Day of *October 1980*

[SEAL]

*Attest:*

SIDNEY A. DIAMOND

*Attesting Officer*

*Commissioner of Patents and Trademarks*